United States Patent [19]

Reed et al.

[11] 4,450,387

[45] May 22, 1984

[54] CRT WITH INTERNAL THERMIONIC VALVE FOR HIGH VOLTAGE CONTROL

[75] Inventors: Ronald G. Reed; Robin R. Schmuckal; Robert K. McCullough, all of Colorado Springs, Colo.

[73] Assignee: Hewlett-Packard Company, Palo Alto, Calif.

[21] Appl. No.: 248,925

[22] Filed: Mar. 30, 1981

[51] Int. Cl.[3] ..... H01J 29/80

[52] U.S. Cl. ..... 315/375; 315/409; 358/73; 313/479

[58] Field of Search ..... 315/375, 409; 358/72, 358/73; 313/479

[56] References Cited

U.S. PATENT DOCUMENTS 2,454,204 11/1948 Raymond .
3,015,749 1/1962 Francken .
4,223,252 9/1980 Doran ..... 315/375

FOREIGN PATENT DOCUMENTS 1281207 7/1972 United Kingdom .
1443032 7/1976 United Kingdom .

*Primary Examiner*—Theodore M. Blum
*Attorney, Agent, or Firm*—Edward L. Miller

[57] ABSTRACT

The magnitude of a DC high voltage supplied to an internal element of a CRT is varied by a thermionic valve that is located within the envelope of the CRT and that forms a voltage divider with an external load resistor. Only a small scale signal referenced near ground is needed to produce a several thousand volt change in the high voltage supplied to the internal CRT element. The variable high voltage may control a variable deflection factor, variable spot size, or in the case of a beam penetration CRT, either variable persistence or variable trace color. In a particular beam penetration color CRT having a split anode the thermionic valve comprises a tetrode flood gun coupled by an electron mirror to a plate region in the neck of the CRT.

9 Claims, 7 Drawing Figures

CRT WITH INTERNAL THERMIONIC VALVE FOR HIGH VOLTAGE CONTROL

High voltage DC switching circuits are often difficult to design and frequently leave much to be desired. Circuits to switch the magnitude of a DC high voltage supplied to a beam penetration color CRT have the additional burden of providing extremely rapid and fairly large swings in voltage, say 6 KV, into a capacitive load. Present day switching time requirements for beam penetration color CRT's range from 25 usec to 500 usec, depending upon a variety of factors. Those factors include whether random color changes are allowed but random changes in beam location are discouraged, or whether beam location changes are encouraged to group the writing of similar colors together to minimize color changes. These differences reflect systems using magnetic versus electrostatic deflection, respectively.

In each case previous solutions for varying the voltage supplied to the CRT have nearly all used what is essentially a variable high voltage power supply external to the CRT. Such supplies have many components that operate at considerable potential above ground, making it awkward for the supply to respond to a control signal generated by low voltage logic circuitry referenced to ground. Furthermore, the large component count associated with the conventional approach gives rise to reliability, environmental and safety problems that require elaborate precautions such as shielding, or even potting, the entire circuit. Conventional high voltage switching circuits are also bulky, power comsumptive, and expensive, and therefore are neither easily integrated into new designs for small or compact instruments, nor capable of being retrofitted into existing ones. Some prior art switching power supplies for beam penetration CRT's are even separate rack mounted components the size of a bread box and dissapate between four hundred and five hundred watts. Even recent developments in switching power supplies have not entirely eliminated these drawbacks. See, for example, U.S. Pat. application Ser. No. 968,244, filed Dec. 11, 1978, by Eugene K. Severson, and entitled DC Switching Circuit. The high voltage power supply and switching technique described therein dissapates less than fifteen watts, but is still relatively expensive, completely potted (for safety) and is still nearly the size of a shoe box.

Many types of graphics displays could be upgraded to color from monochrome by substituting a beam penetration color CRT for the existing CRT, provided the necessary extra circuitry could be included merely by a revision of the existing design rather than by the development of a completely new one. The extra power and space required to implement the color-related logic circuitry can often be found, as much of that is done with integrated circuits. Also, a beam penetration CRT need not be any larger than the CRT it replaces. So far, so good, but where to put the additional switching power supply?

For this reason, and for simplicity, convenience and lower cost in new designs as well, it would be desirable if there were an innocuous way to switch the magnitude of the high voltage supplied to CRT's such as those of the beam penetration type. Such a circuit should be of low power dissapation, require little space, be easily controlled by small scale voltages referenced to ground, and be reliable and inexpensive. Such a circuit is the principal object of the present invention.

In the course of certain investigations involving the addition to a beam penetration CRT of certain elements including a flood gun aimed at the screen, it was noticed that an image increased in brightness as the flood gun current increased, in accordance with predictions based on the experimental configuration in use. Attempts to further increase the brightness by further increases in flood gun current quite unexpectedly caused a sudden and increasingly pronounced decrease in brightness as the current was raised above a certain level. An investigation revealed that the conductance of the flood gun was essentially grounding the end of the load resistor connecting the funnel and faceplate to the high voltage power supply. It was recognized that this phenomenon could be employed to considerable advantage in CRT's whose operation required large changes in high voltage, such as in beam penetration color CRT's.

In accordance with a preferred embodiment of the invention the CRT whose high voltage is to be switched is provided with an internal thermionic valve having a heater, cathode, control grid and a plate region connected to a load resistor. The thermionic valve acts as a variable conductance shunt in series with a load resistor between a fixed high voltage supply and ground. The variable voltage to the CRT is available at the plate of the thermionic valve. Very little extra power dissapation is involved: the power dissapation of the extra heater and the dissapation in the load resistor can be selected to be just a few watts each. The thermionic valve is easily located inside the CRT with no increase in volume at all. The load resistor is freqently already there, anyway. Finally, it is readily possible to choose the cathode potential of the thermionic valve so that the control grid signal is conveniently near ground, while the gain of the thermionic valve allows a 40–60 volt signal to produce as much as a 6 KV change in the voltage supplied to the CRT.

Also, in accordance with a preferred embodiment the internal thermionic valve can be a flood gun (of the type used in conventional storage CRT's) coupled through an electron mirror to a plate region on the inside of the neck of the CRT. The electron mirror aids in providing convenient physical mounting as well as significantly reducing the plate to cathode spacing necessary to prevent loss of control grid action at high plate voltages. That is, the electron mirror acts as a screen grid in a tetrode, to isolate the control grid and cathode from the electric field of the plate. Flood guns are small, inexpensive, and readily available. Other cathode-to-plate structures could be used.

In a preferred embodiment the plate region in the neck of the CRT can be either a metal pin sealed in frit or a region of silver paste electrically connected to a terminal outside the envelope of the CRT. This conveniently electrically isolates the plate (upon which there is high voltage) from other elements in the CRT, and nearly eliminates an otherwise nasty insulation problem within the electron gun assembly. In an alternate embodiment the aquadag or other conductive coating within the funnel portion of the CRT can serve as the plate region for the thermionic valve.

The advantages afforded by such a CRT include the following:

Small size. The actual high voltage control mechanism occupies otherwise unused volume within the CRT.

High reliability due to low component count.

No increased safety hazard while servicing the instrument using such a CRT.

Easy control of a high voltage by a low voltage signal referenced to ground.

It will be noted by those skilled in the art that while the same basic electrical performance can be obtained with a vacuum tube external to the CRT, such a circuit does not afford the first three of the four above-mentioned advantages. First, a definite increase in component volume is required simply for the tube and its socket. Second, the need for an extra socket and associated wiring, especially in a high voltage environment, adds to the component count and possible number of failure modes. Furthermore, the manner of fabricating a modern instrument grade CRT ensures that the reliability of such a CRT is very high. The very best an external off-the-shelf tube could do would to be no less reliable. Third, it is likely that the external tube would require shielding in the form of a cage or box. This further adds to the volume and expense.

A 6BK4 would be a suitable choice for an external resistance coupled amplifier to control the high voltage to a beam penetration CRT. It is estimated that it would require approximately sixteen cubic inches to mount that tube. A certain amount of additional stray capacitance is added in the process, which adds to switching time and high voltage power comsumption. The heat generated by the tube must be dissipated and may well prevent semiconductor circuitry from being located in close proximity to the tube, thus effectively using even more volume.

And finally, there is the general consideration of user appeal. In the opinion of many who specify or purchase high quality state-of-the-art equipment it would indeed be a retrograde type of progress to include in an otherwise solid-state product an unnecessary vacuum tube.

DESCRIPTION OF THE PREFERRED EMBODIMENT

Figure 1:
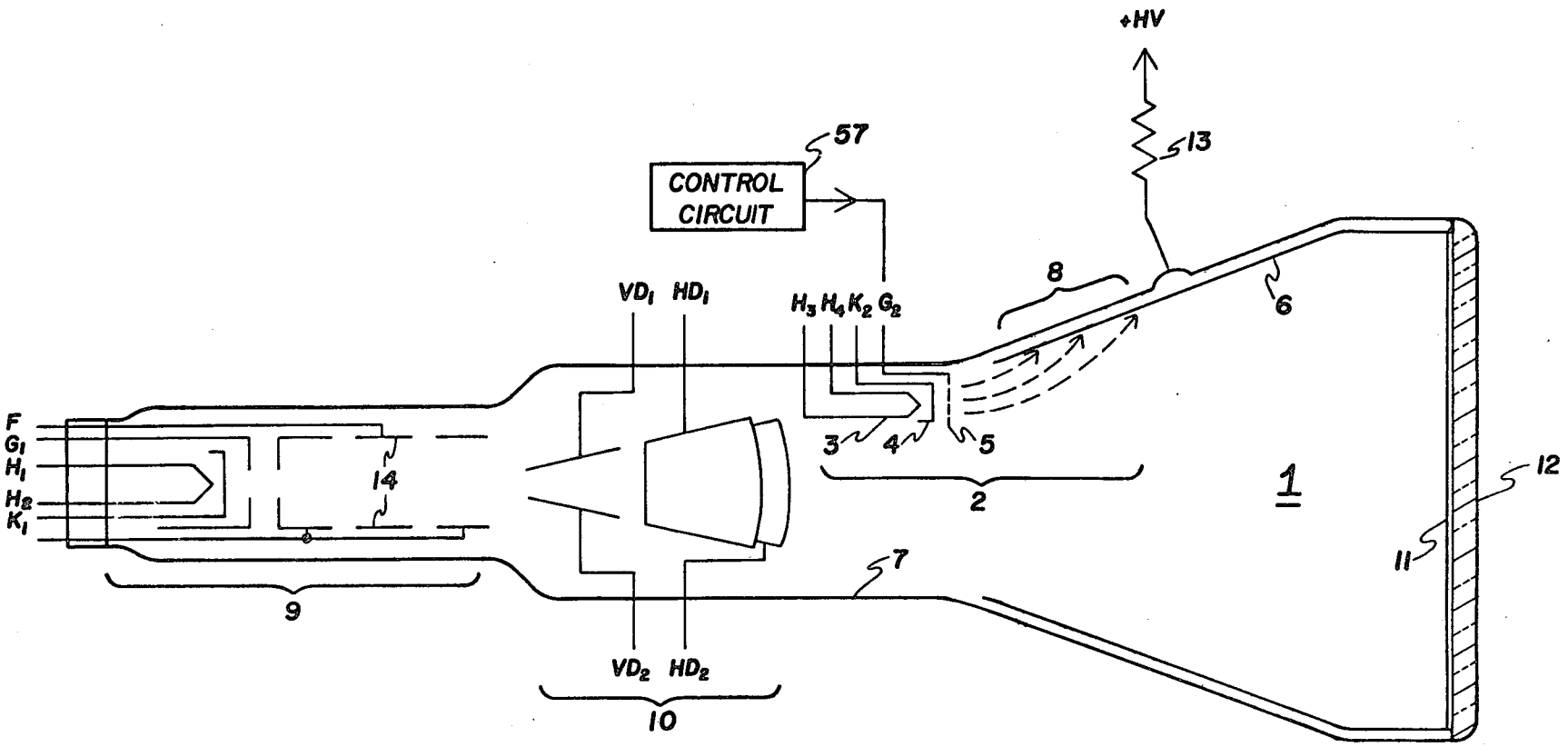
FIG. 1 is a schematic illustration of a CRT whose final acceleration voltage is controlled by an internal thermionic valve coupled to an external load resistor.

FIG. 1 illustrates an electrostatically deflected cathode ray tube 1 incorporating an additional heater 3, cathode 4 and control grid 5 electrostatically coupled to a conductive coating 6 of either aquadag or aluminum inside the funnel portion of the CRT envelope 7. Electrons thermionically emitted from the cathode 4 impinge upon a nearby region 8 of the conductive coating 6. That is, the region 8 acts as a plate for the cathode 4. Taken together, the heater 3, cathode 4, control grid 5 and plate region 8 constitute a triode "vacuum tube" 2, or triode thermionic valve 2. To avoid confusion regarding the meaning of the term "tube", the triode element 2 as well as analogous structures shall hereinafter be referred to as thermionic valves located within a cathode ray tube (CRT). It will be apparent to those skilled in the art that thermionic valves other than those of the triode type are useful in practicing the present invention, and that in certain applications it may be desirable to include more than one such thermionic valve within a CRT.

The remaining elements of the CRT 1 include a conventional single beam electron gun assembly 9 and pairs of vertical and horizontal deflection plates 10. It will also be apparent to those skilled in the art that the present invention can be practiced with CRT's having electron gun assemblies producing multiple beams, and with CRT's employing magnetic deflection, magnetic focusing, or both.

In the example of FIG. 1 a load resistor 13 is connected between a high voltage power supply (not shown) and the conductive coating 6 inside the funnel. The conductive coating 6 acts as an accelerator whose degree of acceleration depends upon the voltage applied thereto. The accelerated beam of electrons strikes a phosphor coating 11 deposited upon the inside of the CRT faceplate 12.

The operation of the CRT 1 of FIG. 1 is as follows. When the control gird 5 is biased sufficiently negative with respect to the cathode 4 no electrons leave the vicinity of the cathode 4, and the only current through the load resistor 13 is the beam current from the electron gun 9, collected by the conductive coating 6 after striking the phosphor layer 11. The beam current from the electron gun is quite small (typically 20–25 ua) even at maximum intensity. By itself, the beam current does not create a significant voltage drop across the load resistor 13, and the voltage at the coating 6 is essentially the same as that at the high voltage power supply. Thus, when the triode thermionic valve 2 is biased into cutoff there is maximum high voltage on the conductive coating 6 and the electron beam is subjected to maximum acceleration before striking the phosphor layer 11.

Now consider the case when the triode thermionic valve 2 is biased at a value less than cutoff. The current emitted from the cathode 4 and passing the control grid 5 reaches the plate region 8 of the conductive coating 6. This current also flows into the high voltage power supply via the load resistor 13. However, as this current can be considerably larger than the beam current from the electron gun 9, depending upon bias between the control grid 5 and the cathode 4, and since the value of the load resistor 13 is typically several megohms, the thermionic valve 2 and the load resistor 13 comprise a variable ratio voltage divider capable of reducing the voltage on the conductive coating 6 to levels sufficiently low that the electron beam from the electron gun 9 is no longer sufficiently accelerated to produce a visible trace upon the CRT screen. By proper control of the bias applied to the thermionic valve 2 the voltage upon the conductive coating 6 can be set at any value between the two extremes.

In the case where the phosphor layer 11 is of the beam penetration type the different levels of acceleration applied to the beam from the electron gun 9 will produce different colors, in accordance with the bias applied to the thermionic valve 2. Of particular advantage in that case is the fact that the color controlling grid signal need have only a relatively small excursion (say, 50 V or perhaps 75 V) and need have only a low voltage DC component of, say, less than 100 V, rather than one of several thousand volts. The circuitry needed to supply a color control signal to control grid 5 is therefore considerably simpler than that for conventional methods of varying the high voltage supplied to a beam penetration color CRT.

A thermionic electron valve located within a CRT can be useful in other applications where some desirable effect is to be produced by varying the high voltage supplied to one or more elements in the CRT. It is well known that the deflection factor can change as a function of an applied acceleration voltage. A thermionic electron valve located within a CRT would be an excellent way to vary the high voltage supplied to a properly located accelerator element in the CRT for the purpose of determining the deflection factor. In a similar manner, spot size on the faceplate is also a function of large changes in a fairly high voltage supplied to a lens element in the electron gun, similar to that denoted by focus lens 14 in electron gun 9. A low cost and easy to implement ability to vary the spot size would be of value in graphics systems having an "area fill" operation; less time could be spent filling in the area if the spot size could be temporarily increased. If the intensity were also increased, the apparent brightness could be adjusted to appear unchanged. A pair of internal thermionic valves within the CRT would allow small scale signals referenced to ground to independently vary the spot size and brightness without using cumbersome external high voltage circuitry.

The beam penetration concept and the convenience of the internal thermionic valve can combine to produce still other types of desirable CRT performance. Instead of choosing the tube's phosphors on the basis of color, they could be choosen on the basis of their persistence. Then, instead of a beam penetration color CRT with a low voltage color control terminal, one would have a beam penetration CRT with a variable persistence control terminal. If the persistence were long enough, such a tube would begin to resemble a storage tube in some aspects of its capability.

Figure 2:
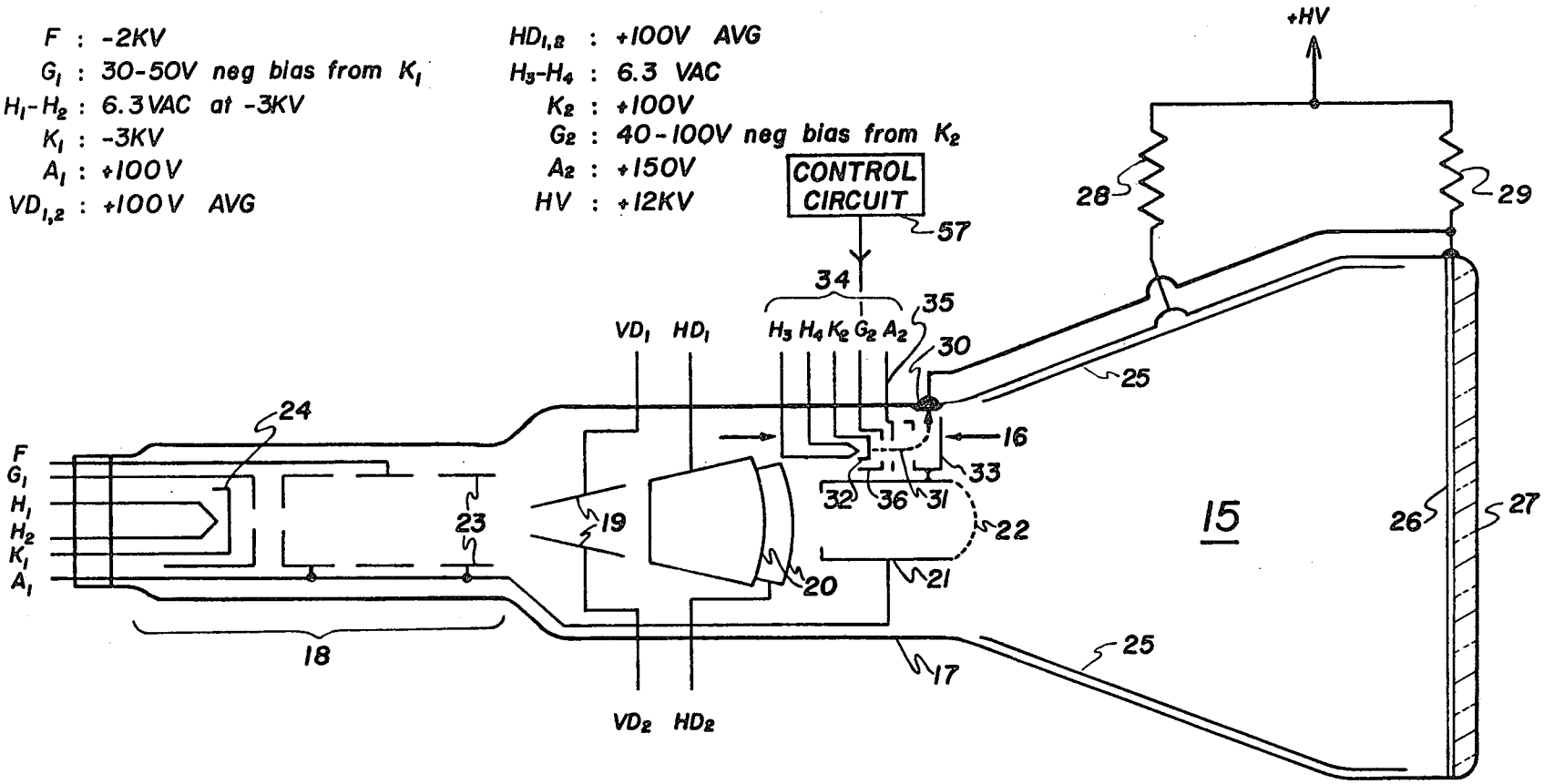
FIG. 2 is a schematic illustration of a split-anode beam penetration color CRT whose trace color is determined by the degree of conductance of an internal tetrode flood gun coupled through an electron mirror to a plate region which is on the neck of the CRT and which is connected to a load resistor.

FIG. 2 is a more detailed illustration of a split-anode beam penetration color CRT 15 having an internal thermionic valve 16 for controlling the color of the trace. As in the CRT 1 of FIG. 1 the CRT 15 of FIG. 2 has within its envelope 17 an electron gun assembly 18 whose output beam is deflected first by vertical deflection plates 19 and then by horizontal deflection plates 20. The deflected electron beam enters a "mesh can" 21 whose purpose is to support an expansion mesh 22. In the present example the potential of the mesh can 21 and the expansion mesh 22 are the same as the potential of the first accelerator portion 23 at the exit of the electron gun 18, which is +100 V above ground. (The cathode 24 of the electron gun 18 operates at −3 KV below ground.)

In CRT 15 a conductive coating 25 of aluminum is deposited upon the interior surface of the funnel portion of the envelope 17. However, the conductive coating 25 does not extend all the way to the aluminized phosphor coating 26 on the inside of the faceplate 27. Separate load resistors 28 and 29 supply high voltage to the conductive coating 25 and to the aluminized phosphor layer 26, respectively. By reducing capacitance this "split-anode" technique reduces the power and time required to switch the high voltage controlling the color of the trace. The relatively large capacitance of the conductive coating 25 is left steadily charged through load resistor 28 to the value of the high voltage power supply. Only the lower capacitance of approximately twenty picofarads for the aluminized phosphor layer 26 need be discharged to lower the voltage and then recharged through load resistor 29 to raise the voltage.

To switch the voltage a conductive plate region 30 is established on the inside of the neck portion of the envelope 17. An electrical connection to this plate region is made from outside the envelope and is used to connect the plate region 30 with the aluminized phosphor layer 26. Then, as in operation of the CRT 1 of FIG. 1, the color of the trace will be determined by conductance of the thermionic valve 16. A control circuit 57 determines different conductances of the thermionic valve by varying a bias voltage applied to the control grid thereof.

One way to provide a plate region 30 is simply to pass a metal pin through a hole and seal it with frit. Then a wire can be soldered between the pin, which acts as the plate region 30, and the terminal connecting the load resistor 29 to the aluminized phosphor layer 26. Another way for providing the plate region 30 and another way for connecting it to the phosphor are discussed in connection with FIG. 5.

In CRT 15 the thermionic valve 16 includes a "flood gun" 34 of the type commonly used in storage CRT's. The electrons 31 from the cathode 32 of the flood gun 34 are deflected 90° toward the plate region 30 by an "electron mirror" 33. This enhances the ease of mounting the flood gun 34. It also significantly increases the maximum plate-to-cathode operating voltage at a given separation thereof, and avoids the need for outrageously high bias values at high plate voltages. That is, it acts as a screen grid to isolate the electric field of the cathode from that of the plate. A flood gun was chosen for the reasons that it was readily available, easy to mount and inexpensive. The particular flood gun selected includes an accelerator element 35 in addition to a control grid 36. The construction details of the flood gun 34 and electron mirror 33 are discussed in connection with FIGS. 3 and 4.

For convenience, the electron mirror 33 operates at the +100 V potential of the mesh can 21. The cathode 32 of the flood gun 34 operates at the same potential. This allows the control grid 36 to operate very near ground, as it requires only a negative bias of from forty to one hundred volts with respect to the cathode 32. The accelerator element 35 operates at +150 V above ground either directly or through a load resistor (not shown).

One way to operate the beam penetration CRT 15 is to bias the thermionic valve 16 into cutoff to obtain the color associated with highly accelerated electrons, and bias it at some nominal value for the other extreme. Under these conditions the maximum voltage at the phosphor layer 26 is the supplied high voltage less the voltage drop of the beam current through the screen load resistor 29. This method works well, but does not result in the fastest switching time between low and high voltages at the phosphor screen 26. For while the thermionic valve is an active pulldown that can theoretically discharge the capacitance of the aluminized phosphor coating 26 as fast as desired (given the right valve characteristics, of course), the recharging of the capacitance to raise the voltage level is limited by the time constant created by the screen load resistor 29. Of course, that resistor can be reduced in value, but only to a point where high voltage power supply current levels and overall power consumption begin to outweigh other considerations. Even with a large valued screen load resistor 29, "slow" color changes are not necessarily a problem if all or most traces of the same or nearly the same color are drawn before changing to an unrelated color. This is frequently not difficult if the frame rate is slow, say 60 Hz, and the tube is electrostatically deflected. In an electrostatically deflected tube there is little or no intrinsic time penalty for consecutively writing traces of the same color located at widely separated parts of the screen. Magnetically deflected tubes cannot change the beam position nearly as easily, owing to the high inductance of the deflection coils. Systems using magnetically deflected CRT's tend to change color rather than beam position, thus requiring lower switching times. Phosphor layer capacitance recharge times as low as desired can be obtained with the present invention by making the value of the screen load resistor 29 sufficiently low while ensuring that the high voltage source can supply and the thermionic valve 16 can draw the requisite amounts of current.

In another mode of operation a modest increase in power dissapation results in a significant decrease in recharge time of the phosphor layer capacitance. This is achieved by choosing value of the high voltage and the CRT's beam penetration characteristics such that the maximum necessary acceleration of the electron beam is obtained without steadily biasing the thermionic valve 16 into cutoff. Instead, the highest steady state value for the voltage at the plate region 30 and phosphor screen 26 is choosen to be, say 75% or 80% of the available high voltage. Then the recharge time of the phosphor layer's capacitance to that reduced maximum value can be shortened by briefly biasing the thermionic valve into cutoff anyway, and then returning to the desired value of conductance. In this way, one recharge time constant at a higher voltage can be made to do the work of several at a lower voltage.

This latter scheme has been found to work satisfactorily with the CRT 15 of FIG. 2, with a high voltage of +12 KV, a funnel load resistor 28 of 10 MΩ, and a screen load resistor 29 of 20 MΩ. The range of steady state voltages for the phosphor layer 26 is from about 4 KV for red, to about 10 KV for green. The time required to switch from red to green is in the vicinity of 400–500 usec; switching from green to red requires less than 200 usec. The maximum current of about 500 ua is easily handled by the flood gun 34, whose saturation current ranges from one to three milliamps.

Figure 3:
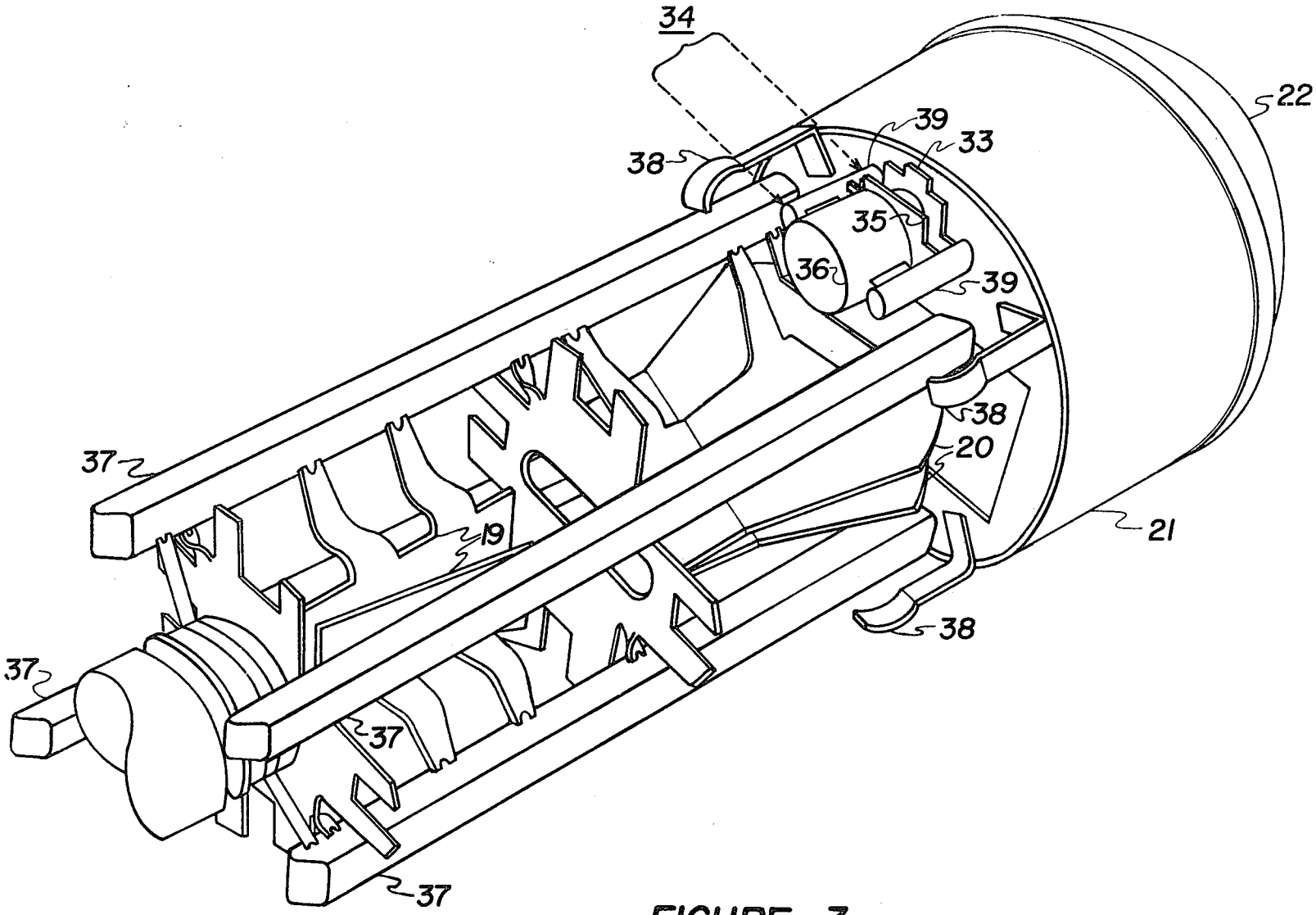
FIG. 3 is a perspective view showing the general physical relationship between the flood gun and elements of the electron gun assembly for the CRT of FIG. 2.

FIG. 3 illustrates a portion of the electron gun and deflection plate assemblies within the neck portion of the CRT 15 of FIG. 2. Four glass rods 37 serve as supports into which legs for the various elements have been embedded. The vertical deflection plates 19 and horizontal deflection plates 20 are visible, and have been mounted in this manner. The mesh can 21 is also attached to the four glass rods 37, and a portion of the actual expansion mesh 22 is visible. Metal fingers 38 are spot welded to the mesh can 21 and serve to support the whole assembly within the neck portion of the CRT.

An aperture plate portion 33 of the electron mirror is spot welded to the mesh can. It has ears that are embedded into short glass rods 39 for the purpose of supporting the glass rods 39, which in turn support the flood gun 34. Control grid 36 has the shape of a cylinder whose end furthest from the mesh can is open, and whose other end is closed except for a small aperture (not visible). The open end of the cylinder 36 receives various spacers, a heater and a cathode, none of which are depicted. The cylinder 36 has mounting ears that are embedded in the glass rods 39. The accelerator element 35 also has mounting ears embedded in glass rods 39.

A CRT having a flood gun ordinarily has an aperture in the mesh can so that the electrons from the flood gun enter the mesh can along their path toward the phosphor screen. In the present example, however, there is no such aperture in the mesh can 21 for flood gun electrons. Instead, the aperture plate 33 and a solid rear portion of the mesh can form the electron mirror.

Figure 4:
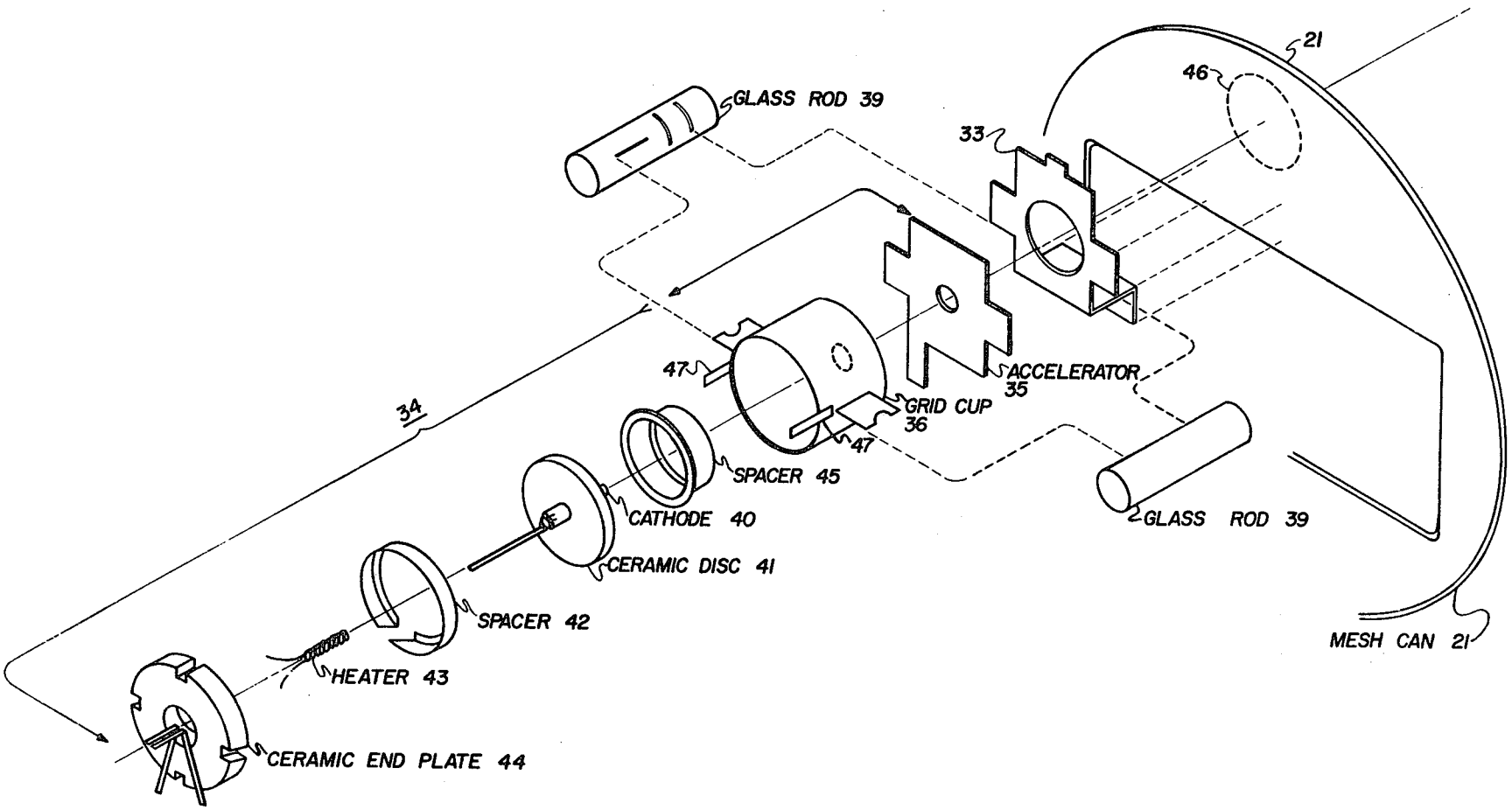
FIG. 4 is a detailed exploded view of the flood gun and electron mirror of FIG. 3.

Turning now to FIG. 4, the flood gun 34 and electron mirror of FIGS. 2 and 3 is shown in greater detail. A tubular cathode 40 is attached to a ceramic disc 41. A heater coil 43 is inserted into the cathode, and the leads of the heater coil 43 are spot welded to terminals on a ceramic end plate 44. A spacer 42 separates the ceramic end plate 44 from the ceramic disc 41. Another spacer 45 supports the ceramic disc 41 against the forward end of the (control) grid cup 36. Once the heater coil 43 and cathode 40 are inside the grid cup 36 two spot welded straps 47 are folded over to act as retainers. The grid cup 36, accelerator 35 and aperture plate 33 are each embedded in glass rods 39. An extended lower portion of the aperture plate 33 is spot welded to the rear of the mesh can 21. Dotted lines 46 show the location of the conventional aperture for admitting flood 9un electrons into the mesh can. As previously stated, this aperture is absent from the mesh can of the present example.

Figure 5:
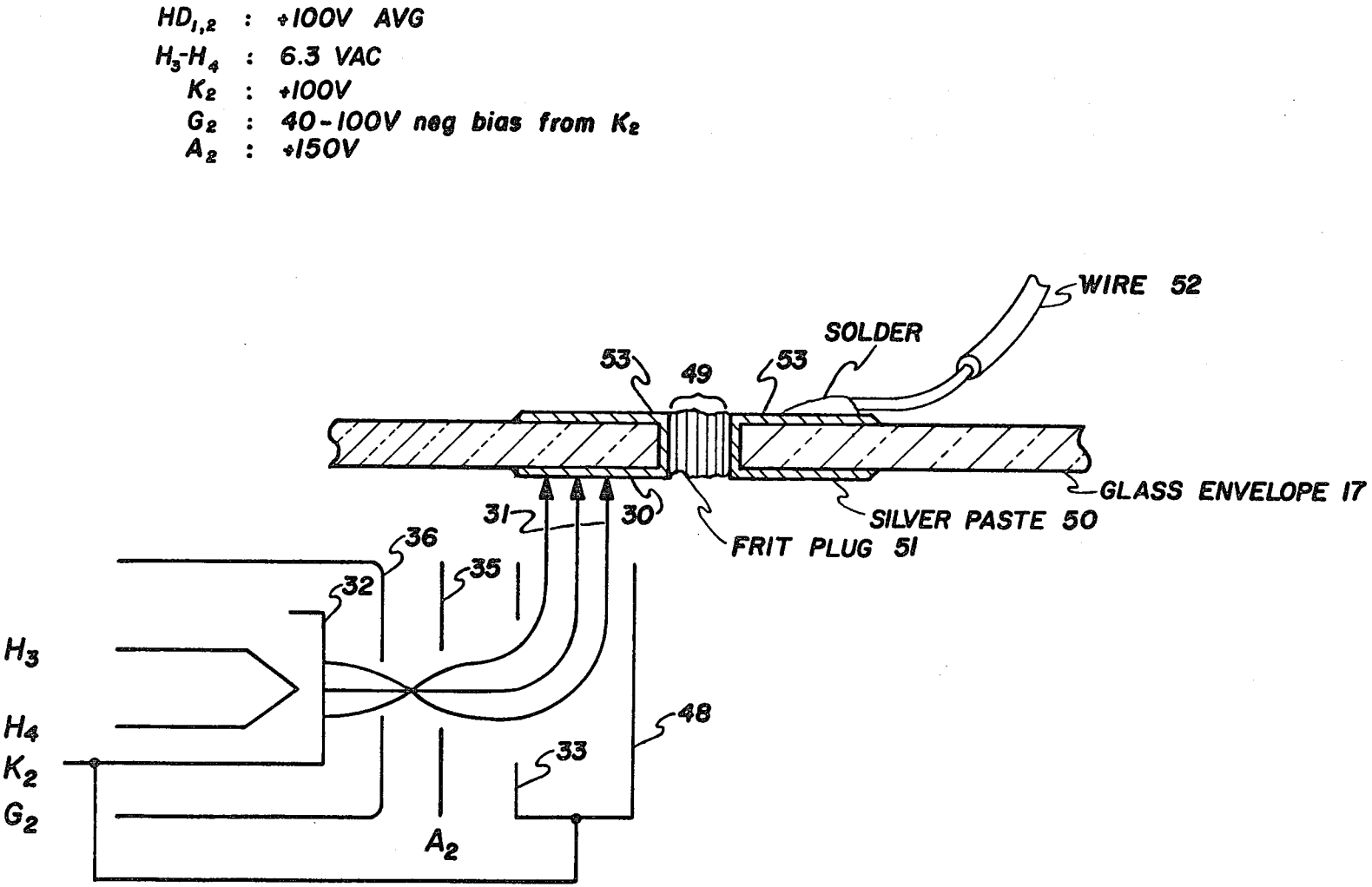
FIG. 5 illustrates the operation of the electron mirror and the construction of the plate region for the flood gun of FIGS. 2, 3, and 4.

FIG. 5 illustrates schematically the path 31 of the electrons under the influence of the electron mirror. Recall that the aperture plate 33 is spot welded to the back surface of the mesh can 21; the element 48 in FIG. 5 represents that portion of the rear surface of the mesh can 21 that influences the path of the electrons 31 as they move toward the plate region 30.

Also shown in FIG. 5 are the details of a way of providing the plate region 30. A hole 49 is bored or cut into the envelope 17, and a layer of silver paste 50 is applied around the hole on both the inside and outside surface of the envelope 17, as well as to the walls inside the hole 49. The hole is then sealed with a plug 51 of melted frit. This establishes a conductive plate region 30 inside the envelope 17 that is electrically connected to a region 53 outside the envelope 17. A wire 52 can be soldered to region 53 to connect it with screen load resistor 29, or alternatively, region 53 can be extended with a strip of silver paste over the outside of the funnel until it reaches the electrical terminal connecting the phosphor layer 26 to the screen load resistor 29. The extended strip of silver paste is then covered with a layer of teflon tape.

Figure 6:
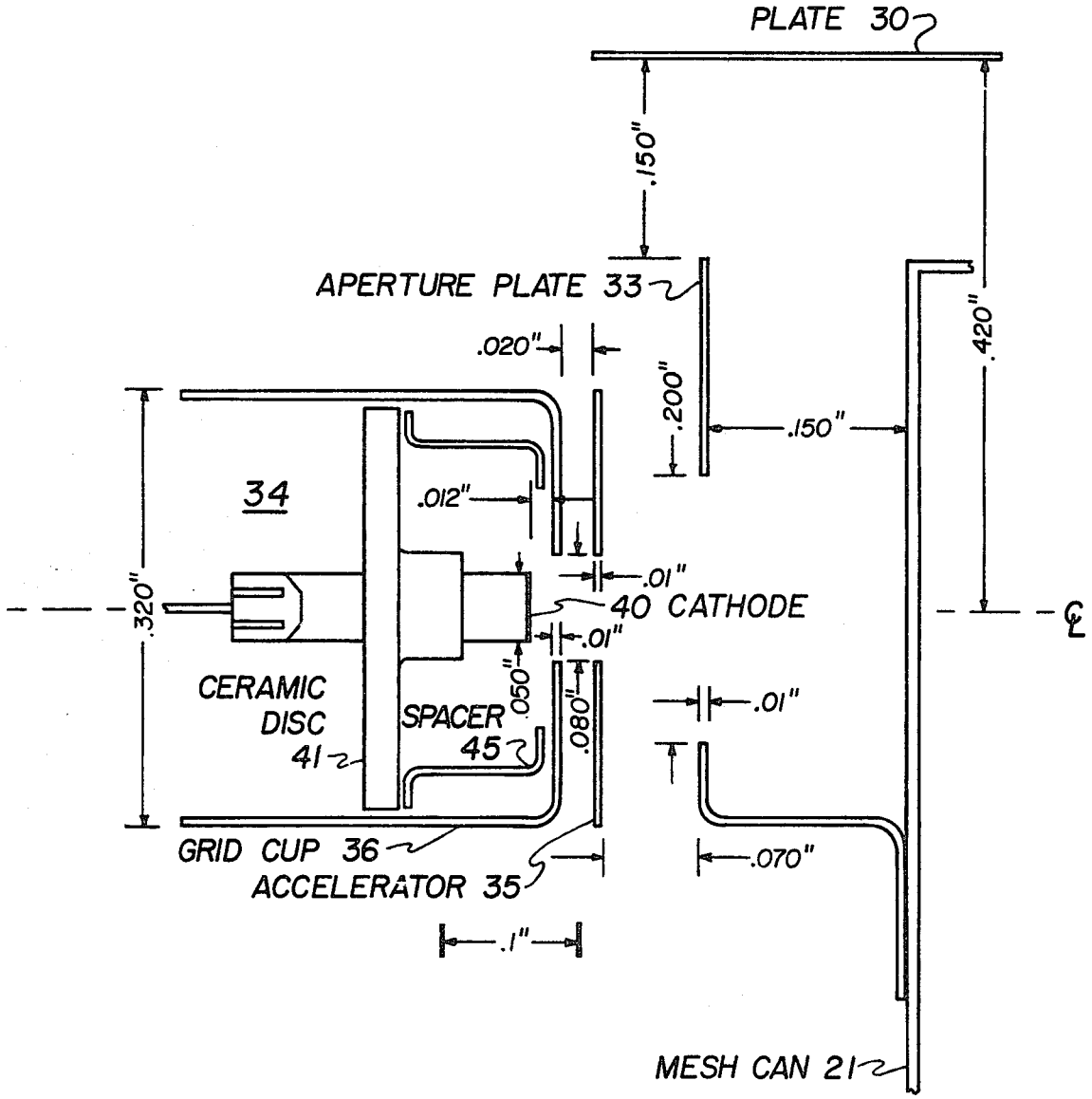
FIG. 6 is a scaled cut-away side view of the electron mirror of FIG. 5.

Turning now to FIG. 6, there is shown a scale cutaway side view of the flood gun 34 as mounted to the mesh can 21 in the proximity of the plate 30. The drawing is dimensioned, and although the various dimensions have in some cases been rounded up or down a few thousands of an inch for the sake of convenience, such changes are minor and the drawing clearly indicates the size and general proportions of the flood gun 34, electron mirror 33/21 and plate 30.

Figure 7:
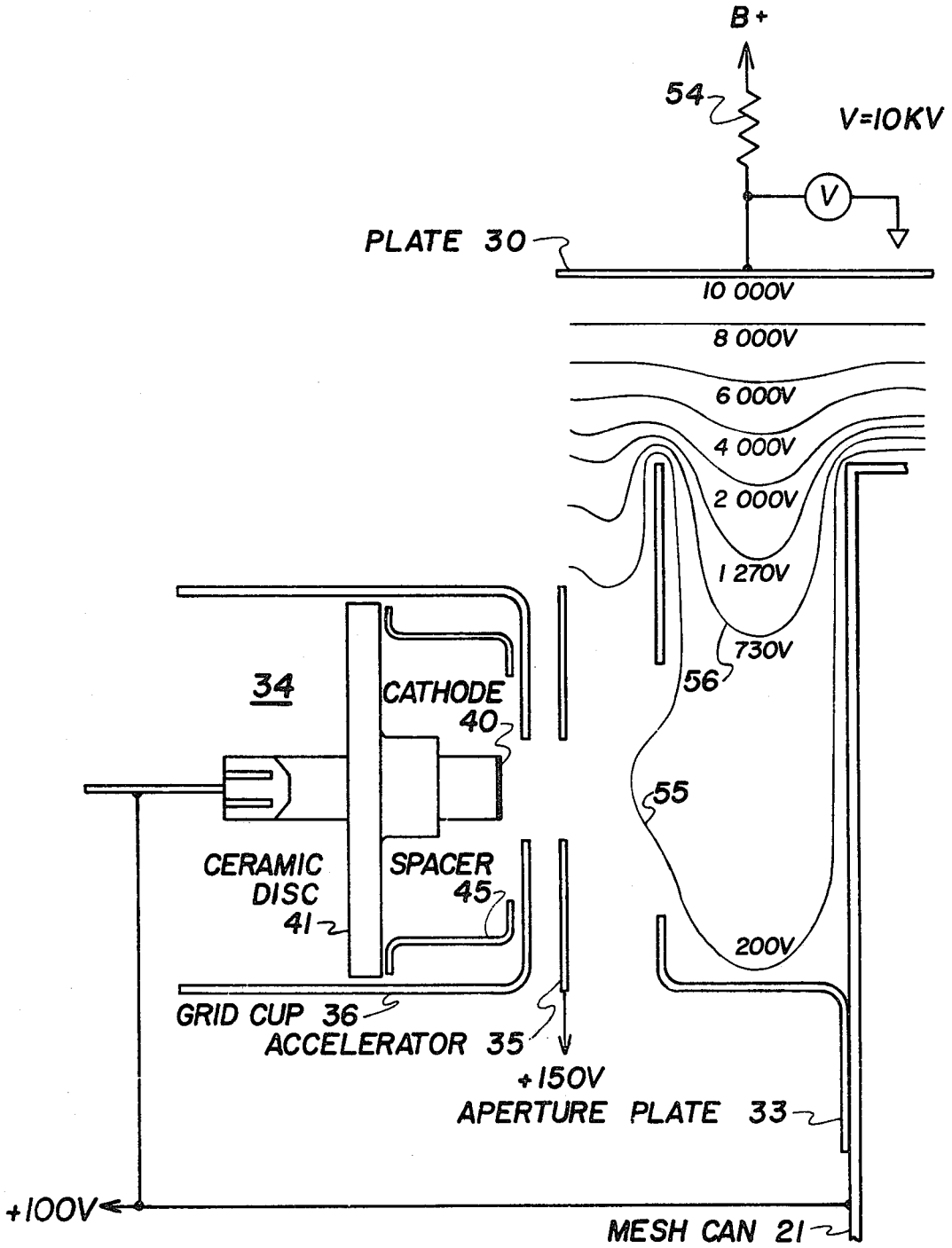
FIG. 7 shows the approximate isopotential lines for the voltage at the plate of the electron mirror of FIG. 6, thus illustrating how the electron mirror isolates the cathode from electric field of the plate.

FIG. 7 shows the same cut-away view of the flood gun 34, electron mirror 33/21 and plate 30 as is shown in FIG. 6. The dimension information has been suppressed to gain room to show an approximation of the isopotential lines existing at a plate voltage of ten thousand volts.

A plate load resistor 54 has been added between a source of high voltage B+ (not shown) and the plate 30. It is to be understood that, in the present example of FIG. 7, any value for the high voltage B+ of ten thousand volts or higher could be used, and that the values of the isopotential lines are a function of the voltage at the plate 30, which in turn is a function of the conductance of the flood gun 34, the value of the plate load resistor 54, as well as of the value of the high voltage B+. The plate voltage of ten thousand volts was choosen to illustrate a credible maximum value corresponding to the type of operation previously described.

FIG. 7 illustrates how the electron mirror formed by the aperture plate 33 and the rear of the mesh can 21 operate to isolate the electric field of the cathode 40 from that of the plate 30. That is, only a very low voltage field from the plate gets anywhere near the cathode 40 and grid cup 36. Note, for instance, that the 200 V isopotential line 55 never even gets within about 0.080 inches of the aperture in the grid cup 36. This ensures that modest amounts of bias (say, less than 100 V) will be sufficient to produce cutoff, even at very high (10 KV or more) plate voltages. It should be noted that the space between the 200 V isopotential line 55 and the 730 V isopotential line 56 constitutes a low voltage drift region within which the electrons emitted by the cathode 40 make a ninety degree turn before being rapidly accelerated toward the plate 30. Thus, the electron mirror formed by the aperture plate 33 and the rear of the mesh can 21 serves two useful functions. First, it acts in the manner of a screen grid to isolate the cathode from the electric field of the plate, allowing high plate voltages and minimal cathode-to-plate spacing, while obviating the need for an outrageously high value of bias to obtain cut-off. Second, it provides an excellent way to mount the flood gun so that its axis is parallel to the axis of the electron gun. That makes it easier to bring out the leads without disturbing the optics of the electron gun. At the same time, the electron mirror couples the electrons from the flood gun 34 to the plate 30, located upon the neck of the CRT envelope. That requires the right angle bend.

The flood gun 34 and electron mirror 33/21 employ an aperture architecture rather than one of meshes or screens. This has the advantages of easy and extremely rugged construction, low cost, and nearly 100% beam transmission. While other thermionic valve architectures are possible, that of apertures offers high utility. The entire flood gun thermionic valve described herein, including electron mirror and plate, occupies less than one cubic inch of otherwise unused volume within the existing envelope of the CRT.

We claim:

1. A split anode penetration cathode ray tube comprising:

an evacuated envelope including funnel and faceplate portions;

electron gun means for producing an electron beam to strike the faceplate;

a conductive layer of beam penetration phosphors, located upon the interior surface of the faceplate poriton of the envelope, for producing a visible indication at the location of the impact of the electron beam upon the faceplate;

a conductive coating upon the inside surface of the funnel portion of the envelope for accelerating the electron beam toward the faceplate, the conductive coating electrically isolated from the conductive layer of beam penetration phosphors;

a cathode for emitting electrons;

plate means, electrically connected to the conductive layer of beam penetration phosphors, for attracting the electrons emitted by the cathode, and for controlling the magnitude of the voltage applied to the conductive layer of beam penetration phosphors;

grid means, located between the cathode and the plate means, for controlling the quantity of emitted electrons reaching the plate means;

a source of high voltage;

a first resistance connected between the source of high voltage and the conductive layer of beam penetration phosphors;

a second resistance connected between the source of high voltage and the conductive coating inside the funnel portion; and control means, coupled to the grid means, for controlling the voltage applied to the conductive layer of beam penetration phosphors.

2. An electron valve comprising:

cathode means for emitting electrons;

plate means for emanating an electric field to attract electrons emitted by the cathode means;

grid means, interposed between the cathode means and the plate means, for controlling the quantity of emitted electrons reaching the plate means; and conductive surface means for isolating the region between the cathode means and the grid means from the electric field emanating from the plate means, the conductive surface means circumscribing with a conductive surface a volume located between the grid means and the plate means and having separate entrance and exit apertures, the entrance aperture located to admit electrons emitted by the cathode means and the exit aperture located to admit the electric field emanating from the plate means, the conductive surface means operating at a potential substantially less than that of the plate means.

3. An electron valve as in claim 2 wherein the entrance and exit apertures lie along a curved path through the volume described by the conductive surface means.

4. An electron valve as in claim 2 wherein the grid means comprises a conductive surface having a circular aperture.

5. An electron valve as in claim 2 wherein the cathode is a thermionic cathode.

6. An electron valve as in claim 2 wherein that valve is located within the envelope of a CRT, wherein the plate means is connected to a voltage sensitive element that affects an aspect of the CRT trace, and wherein a signal applied to the grid means varies that aspect.

7. An electron valve as in claim 6 wherein the CRT is a beam penetration color CRT and the aspect of the CRT trace is the color of that trace.

8. An electron valve as in claim 6 wherein the CRT is a variable persistence CRT and the aspect of the CRT trace is the persistence of that trace.

9. An electron valve as in claim 2 further comprising:

an accelerator means interposed between the grid means and the conductive surface means for accelerating electrons into the conductive surface means.

* * * * *

UNITED STATES PATENT AND TRADEMARK OFFICE

CERTIFICATE OF CORRECTION

PATENT NO. : 4,450,387

DATED : May 22, 1984

INVENTOR(S) : Ronald G. Reed et al.

It is certified that error appears in the above-identified patent and that said Letters Patent is hereby corrected as shown below:

Column 1, line 43, "application" should be --Application--;

Column 2, line 32, "inside" should be --inside--;

Column 5, line 68, "not" should be --not--;

Column 8, line 17, "no" should be --no--;

Column 8, line 36, "9un" should be --gun--;

Column 9, line 68, "porition" should be --portion--;

Signed and Sealed this

*Twenty-third* Day of *October 1984*

[SEAL]

*Attest:*

GERALD J. MOSSINGHOFF

*Attesting Officer*

*Commissioner of Patents and Trademarks*